United States Patent [19]

Larin et al.

[11] Patent Number: 4,979,369

[45] Date of Patent: Dec. 25, 1990

[54] CRYOGENIC SORPTION PUMP

[76] Inventors: Marxen P. Larin, prospekt Nauki, 29, kv. 78; Maxim L. Alexandrov, prospekt Engelsa, 63, korpus 3, kv. 89; Valery I. Nikolaev, prospekt Rentgena, 15/31, kv. 8, all of Leningrad, U.S.S.R.

[21] Appl. No.: 439,368

[22] PCT Filed: Feb. 10, 1989

[86] PCT No.: PCT/SU89/00035

§ 371 Date: Nov. 14, 1989

§ 102(e) Date: Nov. 14, 1989

[87] PCT Pub. No.: WO89/08779

PCT Pub. Date: Sep. 21, 1989

[30] Foreign Application Priority Data

Mar. 10, 1988 [SU] U.S.S.R. ..... 4391234

[51] Int. Cl.[5] ..... B01D 8/00

[52] U.S. Cl. ..... 62/55.5; 55/269; 62/268; 417/901

[58] Field of Search ..... 62/55.5, 268; 55/269; 417/901

[56] References Cited

U.S. PATENT DOCUMENTS

| | | | |
|---|---|---|---|
| 3,157,480 | 11/1964 | Van Baukering | 62/55.5 |
| 3,220,167 | 11/1965 | Vander Ster et al. | 62/55.5 |
| 3,310,227 | 3/1967 | Milleron | 62/55.5 |
| 3,335,550 | 8/1967 | Stern | 62/55.5 |
| 3,416,326 | 12/1968 | Stuffer | 62/55.5 |
| 3,552,485 | 1/1971 | Le Jannoli et al. | 62/55.5 |
| 3,668,881 | 6/1972 | Thibault et al. | 62/55.5 |
| 3,788,096 | 1/1974 | Brilloit | 62/55.5 |
| 4,494,381 | 1/1985 | Lessard | 62/55.5 |
| 4,607,493 | 8/1986 | Sukenobu | 62/55.5 |

FOREIGN PATENT DOCUMENTS

| | | | |
|---|---|---|---|
| 547549 | 5/1977 | U.S.S.R. | 62/55.5 |
| 659792 | 4/1979 | U.S.S.R. | 62/55.5 |
| 696176 | 11/1979 | U.S.S.R. | 62/55.5 |
| 769080 | 6/1980 | U.S.S.R. . | |
| 992814 | 1/1983 | U.S.S.R. | 62/55.5 |
| 1333833 | 8/1987 | U.S.S.R. . | |
| 1292489 | 10/1972 | United Kingdom . | |

OTHER PUBLICATIONS

Journal of Technical Physics, M. P. Larin, Kondensatsionno-absorbtionnaya i sorbtsionnaya otkashka pri temperaturakh tverdogo azota, Zhurnal tekhnicksskoy fiziki, 1988, vol. 58, No. 10, Oct., Nauka Publishers (Leningrad Branch, pp. 2026–2039).

*Primary Examiner*—Ronald C. Capossela
*Attorney, Agent, or Firm*—Lilling and Lilling

[57] ABSTRACT

A cryogenic sorption pump including a pumping element complete with a vessel for a lower temperature cryogenic agent, a radiation screen encompassing the pumping element, a pipe, and a heat bridge. The radiation screen incorporates a vessel for a higher temperature cryogenic agent, a shell having its lower end connected to said vessel and its upper end, to the pump housing, and a chevron screen. The heat bridge is installed between the shell and the pumping element and has its upper end connected to the shell and its lower end to the vessel of the pumping element. The pipe passes within the space defined by the inner walls of the vessels and has its lower end connected to the bottom of the housing and its upper end to the vessel of the pumping element. During pump operation, a protective vacuum space is formed in the space between the radiation screen and the housing, and another protective vacuum space is formed in the space defined by the radiation screen, the pipe, the pumping element vessel, and the heat bridge. These spaces and preclude heat exchange by evacuated gases at pressures of above $10^{-2}$ Pa between the housing and the radiation screen and between the latter and the pumping element, respectively.

4 Claims, 3 Drawing Sheets

CRYOGENIC SORPITION PUMP

BACKGROUND OF THE INVENTION

1. Field of the Invention

The present invention relates to vacuum engineering, more specifically, to cryogenic sorption pumps, and can be used to produce superclean and oil-free vacuum within a pressure range of $10^2$ to $10^{-7}$ Pa while evacuating any gases excepting helium and including corrosive ones from chambers of various designations, measuring from 0.01 to several hundred cubic meters in volume.

2. Description of the Related

There is known a cryogenic sorption pump (SU-,A,1333833) comprising a pumping element consisting of a circular vessel containing liquid nitrogen, a porous screen arranged coaxially with the vessel within a space encompassed by its inner side surface, and a sorbent located within the gap between the inner side surface of the vessel and the porous screen.

This pump is disadvantageous in that at the liquid nitrogen temperature the sorbent has a low sorption capacity at low equilibrium pressures (below $10^{-3}$-$10^{-4}$ Pa) of adsorbable gases. As a result, this type of pump fails to provide limiting pressures of below $10^{-3}$ Pa even after a shortterm gas load. To increase the sorption capacity of the pump, the sorbent may be cooled by means of solid nitrogen down to 55°-50° K., but the sorbent cannot be maintained at those temperature for a long time because of high natural heat input to the nitrogen-containing vessel, the nitrogen contents rapidly warming up after evacuation of nitrogen vapors is discontinued. The operation of this pump is hampered by the need for frequently charging the vessel with liquid nitrogen and repeatedly evacuating nitrogen vapors.

Another prior-art cryogenic sorption pump (M. P. Larin, Kondensatsionno-adsorbtsionnaya i sorbtsionnaya otkachka pri temperaturakh tverdogo azota, Zhurnal tekhnicheskoy fiziki, 1988, vol 58, No. 10, October, Nauka Publishers (Leningrad Branch), pp. 2026-2039) comprises a housing complete with a cover fitted with an inlet nozzle for connection of the space to be evacuated and, arranged in the housing, a pumping element and a radiation screen encompassing the pumping element. The pumping element has the form of a circular vessel designed to contain cryogenic agent, with a heat conductor disk welded to its bottom, and heat conductor and porous screen shells arranged coaxially with the vessel and attached to the heat conductor disk. The interspaces between the heat conductor shells and the porous screen shells adjacent thereto are filled with a sorbent material, while the interspaces between the adjacent porous screen shells communicate with the inlet nozzle of the pump.

The radiation screen contains a toroidal vessel adapted to contain cryogenic agent and installed under the pumping element vessel, a shell arranged coaxially with the pumping element, and a chevron screen installed between the pumping element and the inlet nozzle. The lower end of the radiation screen shell is attached in a pressure tight manner to the radiation screen vessel, with the upper end of the shell fitted with a cover connected with the inlet nozzle through a bellows-form heat bridge. The housing is provided with a nozzle for evacuation of the space between the housing and the radiation screen.

The pump also contains a thin-walled pipe installed within the space defined by the inner walls of the radiation screen vessel and having its upper end attached in a pressure tight manner to the cover of this vessel and its lower end attached to the housing bottom. Installed across the pipe in its upper section is a chevron screen having a thermal contact with the radiation screen vessel.

During pump operation the radiation screen vessel is filled with liquid nitrogen while the pumping element vessel is filled with solid nitrogen, i.e. with a cryogenic agent with a lower temperature. The presence of the radiation screen cooled by liquid nitrogen down to 77.4° K. lowers considerably the heat input by radiation from the housing to the pumping element, making it possible for nitrogen to be maintained in a solid state for a long time—scores of times greater than in the case of the pump discussed above, where sorbent cooling is by means of solid nitrogen.

The space between the thin-walled pipe, the inner wall of the radiation screen vessel, the bottom of said vessel, its outer wall, the radiation screen shell, and the pump housing forms a so-called protective vacuum space. Under normal pump running conditions, the pressure in this space is maintained below $10^{-4}$ Pa, providing for greatly reduced heat input by residual gases from the housing to the radiation screen.

In the pump under discussion, however, the annular gap between the radiation screen shell and the pumping element, as well as the space between the heat conductor disc and the cover of the radiation screen vessel, communicate with the inner pump space, thus with the space to be evacuated, so that considerable heat exchange will occur between the radiation screen and the pumping element at working pressures of between $10^2$ and $10^{-2}$. This will lead to speeding up the process of solid cryogenic agent and sorbent warming up, hence to shortening the continuous pump operation period prior to nitrogen replenishment in the pumping element vessel and to increasing cryogenic agent consumption rates. All this combines to reduce the pump efficiency and increase labor consumption incident to pump operation.

SUMMARY OF THE INVENTION

The invention is based upon the objective of providing a cryogenic sorption pump wherein there would be no appreciable heat exchange by evacuated gases at input pressures of above $10^{-2}$ Pa between the pumping element cooled by a lower temperature cryogenic agent and the radiation screen cooled by a higher temperature cryogenic agent, so that pump efficiency at said pressures might be raised, the consumption rates for the cryogenic agent used to cool the pumping element might be reduced, and so might be the consumption of labor required to maintain the pump in proper running condition.

The objective as stated above is achieved by providing a cryogenic sorption pump comprising a housing complete with an inlet nozzle and, arranged within the housing, a pumping element incorporating a sorbent and a vessel for a lower temperature cryogenic agent, a radiation screen encompassing the pumping element and comprising a toroidal vessel for a higher temperature cryogenic agent and a shell having its lower end connected to said vessel and its upper end connected to the housing, and a thin-walled pipe installed in the space defined by the inner wall of the radiation screen vessel and having its lower end connected in a pressure tight manner to the housing bottom, which cryogenic sorption pump is further provided, in accordance with the invention, with a heat bridge installed between the radiation screen shell and the pumping element and having its upper end attached in a pressure tight manner to the upper part of the shell throughout its perimeter and its lower end to the pumping element vessel throughout its perimeter, with the upper end of the pipe being connected in a pressure tight manner with the pumping element vessel.

The incorporation of a heat bridge into the proposed pump and the attachment of the upper end of the thin-walled pipe to the pumping element vessel provides for the formation of an additional protective vacuum space between the pumping element and the radiation screen. As a result, there is no longer any heat input at pressures of above $10^{-2}$ Pa from the radiation screen to the pumping element on account of heat exchange by evacuated gases, with the pump performance improved accordingly and the consumption rates reduced for the cryogenic agent in the pumping element vessel.

It is advisable for the radiation screen shell to have perforations for the space between the housing and the radiation screen to communicate with the space between the radiation screen and the heat bridge.

This will serve to simplify the pump design and preparation of the pump for operation.

It is also advisable that the pump should contain additionally a toroidal vessel accommodated within the radiation screen vessel and having two nozzles brought out of the housing in a pressure tight manner.

This vessel can be used for preliminary evacuation of a working chamber by means of an ordinary fore pump without running the risk of fouling the space to be evacuated with oil vapors that may evolve from said fore pump. In other words, this additional vessel plays the part of a nitrogen trap incorporated into the cryogenic agent vessel of the radiation screen.

The pump may contain two emergency valves connected to the inlet nozzle, one of said valves communicating with the atmosphere and the other, with the space between the housing and the radiation screen.

These valves serve to enhance the operational reliability of the pump, protecting the thin-walled heat bridge from degradation in emergency situations.

BRIEF DESCRIPTION OF THE DRAWINGS

In the following the invention is made more fully apparent through a detailed description of its preferred embodiment with due references to the accompanying drawings, wherein.

DESCRIPTION OF THE PREFERRED EMBODIMENT

Figure 1:
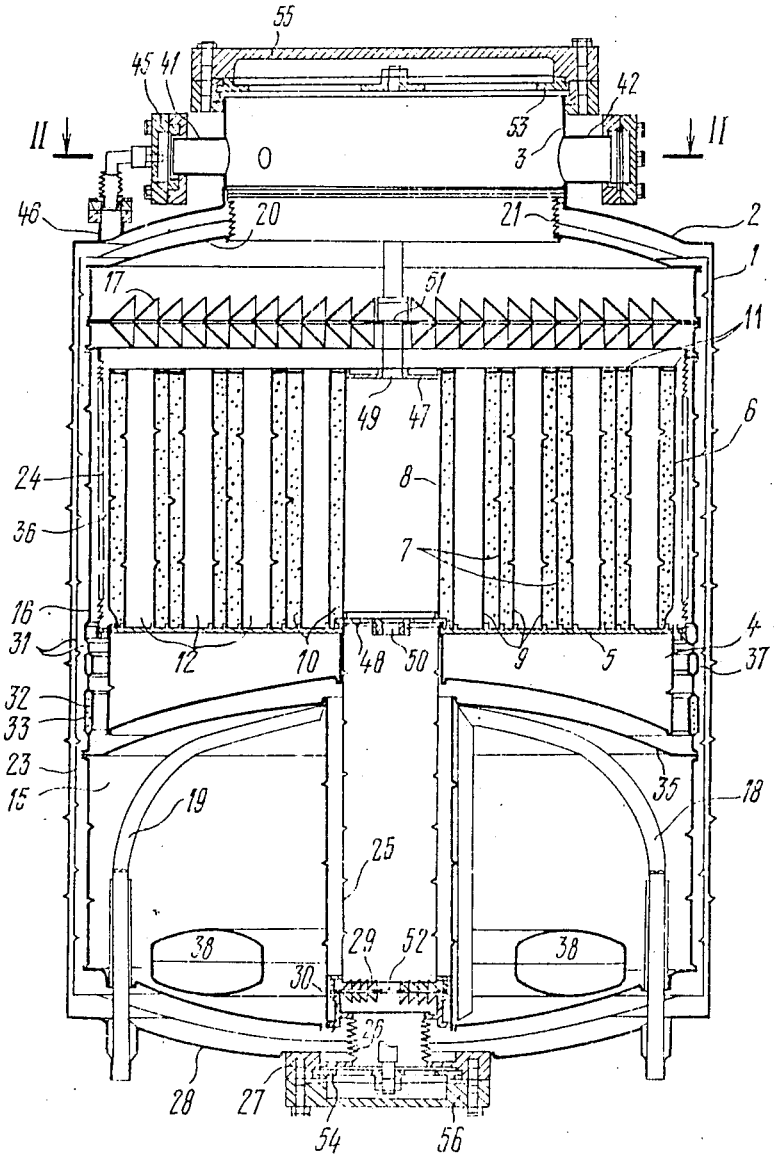
FIG. 1 is a sectional view taken longitudinally and illustrating a cryogenic sorption pump, according to the invention.

The proposed cryogenic sorption pump comprises a housing 1 (FIG. 1) complete with a cover 2 fitted with an inlet nozzle 3. The housing 1 accommodates a pumping element comprising a toroidal vessel 4 designed to contain cryogenic agent and fitted with a cover 5 which has coaxially disposed heat conductor shells 6, 7, and 8, as well as porous screen shells 9 welded to it. The outer heat conductor shell 6 and the inner heat conductor shell 8 are made of solid sheeting while the other heat conductor shells 7 are perforated. The material to be used for the shells 9 can be porous copper, as an example. The outer porous screen 9 is installed on the inner side of the heat conductor shell 6, the inner porous screen, on the outer side of the heat conductor shell 8, and the other porous screens 9, on both sides of the perforated heat conductors 7. The annular spaces 10 between the heat conductor shells 6, 7, and 8 and the porous screen 9 adjacent thereto are filled with a sorbent, such as active carbon. The perforations in the heat conductors 7 surrounded by sorbent on both sides are fitted for the purpose of speeding up the process of equilizing the equilibrium pressure of gases over the sorbent. Rings 11 serve to cover the spaces 10 on top. The annular spaces 12 between adjacent porous screens 9 serve to pass evacuated gases.

Welded to the cover 5 of the vessel 4 in a pressure tight manner are two tubes 13 (FIGS. 2 and 3) communicating with its interior space. The upper ends of said tubes 13 are taken out of the housing 1 and made fast in its cover 2 through the medium of branches 14. The tubes 13 are used to fill the vessel 4 of the pumping element with a cryogenic agent and to remove cryogenic agent vapors therefrom to keep down the temperature of the cryogenic agent charge in the vessel 4.

The pumping element is enclosed in a radiation screen to reduce heat input by radiation from the housing 1. The radiation screen comprises a toroidal vessel 15 (FIGS. 1, 3) to contain a cryogenic agent with a temperature above that of the cryogenic agent filling the vessel 4 of the pumping element, the shell 16, and the chevron screen 17. The vessel 15 is arranged under the pumping element vessel 4, while the shell 16 has its lower part attached in a pressure tight manner to the vessel 15. Inserted into the radiation screen vessel 15 are two tubes 18 and 19 (FIG. 1), the tube 18 being used to receive cryogenic agent into the vessel 15, while the tube 19 serves to remove cryogenic agent vapors. In its upper part the shell 16 has a cover 20 attached through a bellows-like heat bridge 21 to the inlet nozzle 3. To the cover 20 are welded branches 22 (FIG. 3), whose upper ends are welded in a vacuum tight manner to the tubes 13 and branches 14. The chevron screen 17 is installed between the pumping element and the inlet nozzle 3 and attached to the upper part of the shell 16 so as to form an adequate thermal contact therewith.

Between the housing 1 and the radiation screen is installed an additional screen 23 designed to reduce heat input by radiation from the housing 1 to the radiation screen.

According to the invention, the pump contains a vacuum tight heat bridge 24 having the form of a thin-walled shell and installed between the radiation screen shell 16 and the pumping element. The upper end of the heat bridge 24 is attached in a pressure tight manner to the upper end of the shell 16 all over its perimeter while its lower end is secured to the pumping element vessel 4, likewise all over the vessel perimeter. The heat bridge 24 is fabricated from a thin stainless steel tape of 0.15 to 0.2 mm thickness so as to have the smallest possible sectional area while numerous corrugations are intended to increase its actual length. This type of construction of the heat bridge 24 assures lower heat input by conduction from the radiation screen 16 to the pumping element.

The pump also contains a thin-walled pipe 25 passing within the space between the inner walls of the vessels 4 and 15. The upper end of the pipe 25 is connected in a pressure tight manner to the cover 5 of the vessel 4 while the lower end is connected via a bellows 26 to a flange 27 welded to the bottom 28 of the housing 1. In the lower part of the pipe 25 is installed a chevron screen 29 connected to the bottom of the vessel 15 via a ring 30 so as to form an adequate thermal contact therewith.

The space defined by the outer surface of the radiation screen shell 16, the outer wall of the vessel 15, its bottom and the housing 1 serves as a main protective vacuum space 31 precluding heat exchange by residual gases between the radiation screen and the housing 1. To maintain the desired vacuum level within this space 31 there is provided in the shell 16 a circular recess 32 filled with sorbent and covered over by a porous screen 33. To connect a fore pump to the protective vacuum space 31 there is a nozzle with a valve 34 (FIG. 2) installed on the housing cover 2. The space defined by the inner surface of the shell 16 (FIG. 1), the heat bridge 24, the outer wall of the pumping element vessel 4, the bottom of said vessel, the pipe 25, the inner wall of the radiation screen vessel, and the cover 35 of said vessel, serves as an additional protective vacuum space 36 preventing heat exchange by residual gases between the radiation screen and the pumping element. The spaces 31 and 36 intercommunicate via holes 37 provided in the shell 16.

It is obvious that the presence of holes 37 in the radiation screen shell 16 is not an indispensible condition for the embodiment of the invention. No holes will lead to certain complications in the design of the proposed pump and in the process of preparing it for operation, since in this case it would be necessary to equip the housing 1 with an additional nozzle for evacuating the space 36 between the heat bridge 24 and the radiation screen, as well as provide in this space a sorbent-containing element to maintain the desired vacuum level therein. Whereas in the embodiment described herein the intercommunicability of the spaces 31 and 36 makes it possible to have them evacuated at the same time via the nozzle with the valve 34 (FIG. 2) while the sorbent accommodated in the circular recess 32 (FIG. 1) provided in the shell 16 will ensure the desired vacuum level both in the space 31 and in the space 36.

Located inside the radiation screen vessel 15 is a toroidal vessel 38 provided with nozzles 39 (FIG. 3) connected in a pressure tight manner with bellows 40 which are in turn connected with the bottom 28 of the pump housing via nozzles with companion flanges. This vessel 38 performs the function of a nitrogen trap in the process of evacuating a working chamber by means of a fore pump, preventing ingress of oil from said fore pump into the space being evacuated. To this end, one of said companion flanges is connected via a valve to the mechanical fore pump, and the other, to the chamber to be evacuated, likewise via a valve.

Figure 2:
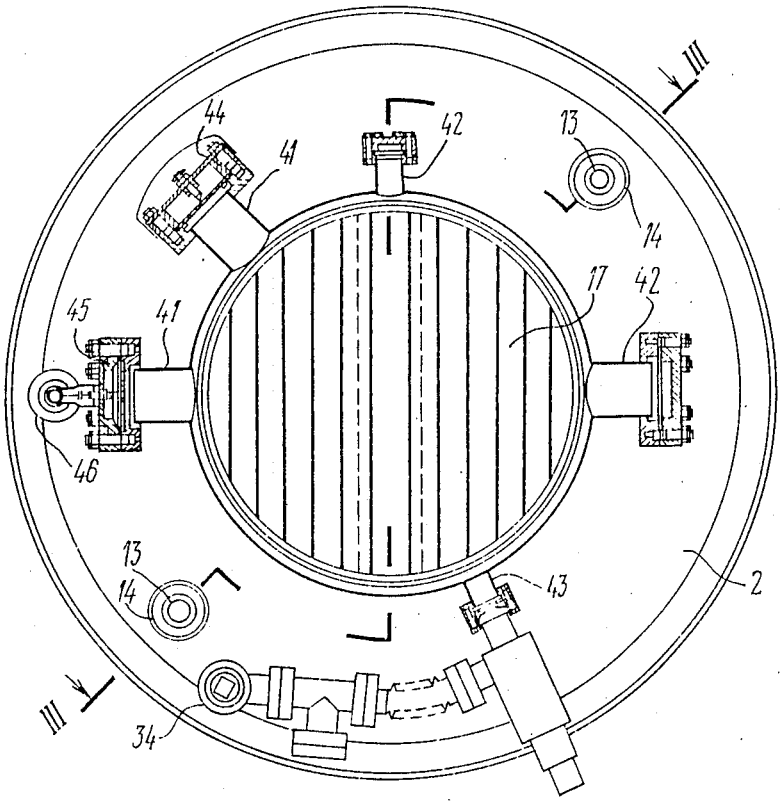
FIG. 2 is a sectional view taken along the line II—II of FIG. 1.
Figure 3:
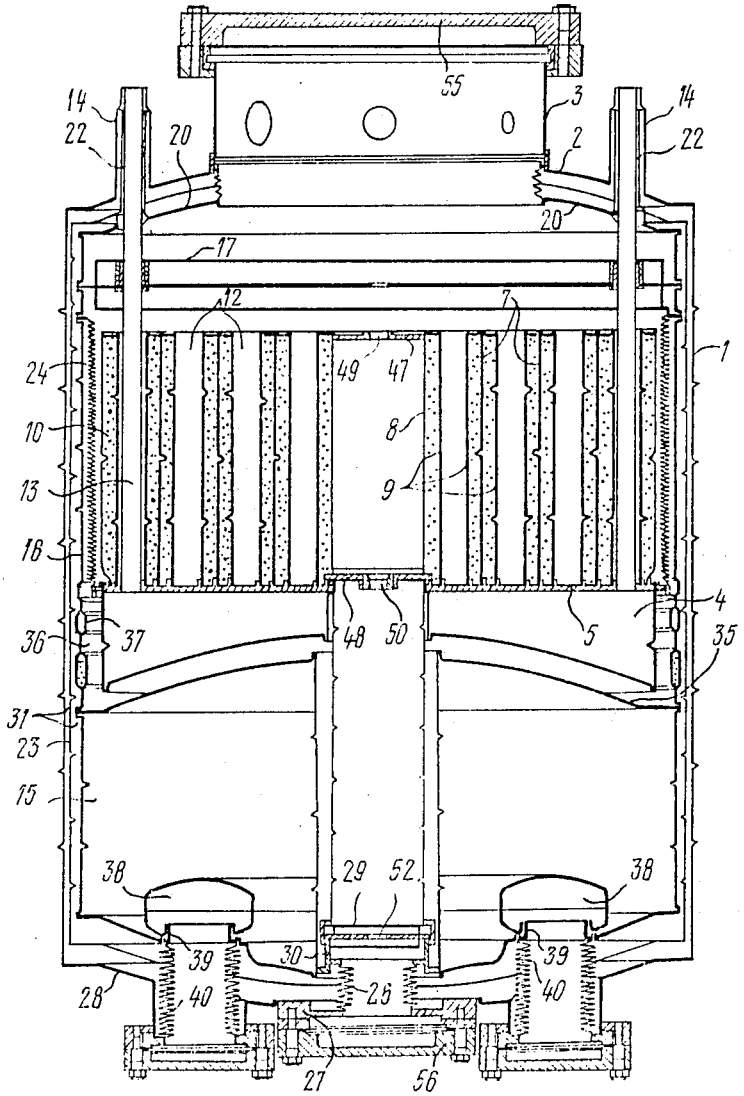
FIG. 3 is a sectional view taken along the line III—III of FIG. 2.

Fitted in the walls of the inlet nozzle 3 are nozzles 41, 42, 43 (FIGS. 1, 2). Connected to one of the nozzles 41 is an emergency valve 44 for the interior space of the pump to communicate with the atmosphere while to the other nozzle 41 is connected an emergency valve 45 for the interior space of the pump to communicate with the protective vacuum space 31 via a nozzle 46. The nozzles 42 are designed for connection of pressure sensors to measure the preliminary and high vacuum levels, while the nozzle 43 is intended for connection, via a valve, of a fore pump for evacuation of a working chamber. The emergency valves 44 and 45 serve the purpose of preventing degradation in emergency situations of the heat bridge 24 (FIG. 1, 3) which has a comparatively large diameter and a small wall thickness and is thus one of the most vulnerable pump elements from the standpoint of mechanical strength.

Installed in the central channel of the pump, along its vertical axis, are discs 47 (FIG. 1) and 48 with holes 49 and 50, respectively, while the chevron screens 17 and 29 are provided with holes 51 and 52, respectively, to pass the transportation safety rod which is secured in a threaded connection in the hole 50 of the disc 48 and in washers 53 and 54. For shipping the pump, the inlet nozzle 3 and the flange 27 are covered over by blind flanges 55 and 56, respectively.

All surfaces of pump elements, except those of the chevron screens 17 and 29 facing the space to be evacuated, have a two-layer coating consisting of a dense aluminium layer no thinner than 1 μm and an aluminium oxide layer of 2 to 20 nm thickness. The chevron screens 17 and 29 have coatings of at least 200 μm thickness with an emissivity factor not lower than 0.99 within a wavelength range of 2 to 200 μm.

The proposed pump operates as follows.

To the inlet nozzle 3 is connected a working chamber to be evacuated (not shown), through a seal (not shown), while the flange 27 receives a magnetic pump (not shown) which is used subsequently for removing nonadsorbable gases such as He and Ne. To the nozzles 43 (FIG. 2) and 34, a mechanical fore pump is connected through the respective valves, and the interior space of the pump, as well as the protective vacuum spaces 31 (FIG. 1) and 36 are evacuated simultaneously. Evacuation of said spaces must be carried out simultaniously in order that the pressure difference within the pump space and the protective vacuum spaces 31 and 36 will not exceed $2 \cdot 10^4$ Pa, otherwise degradation of the heat bridge 24 may result, or a diaphragm rupture may occur in the valves 44 and 45. On reaching a pressure of 100 to 40 Pa in the pump space and in the spaces 31 and 36, the evacuation process is discontinued, and cryogenic agent e.g. liquid nitrogen, is filled into the radiation screen vessel 15 via the tube 18. Cooling the vessel 15 with liquid nitrogen will also cool the sorbent accomodated in the circular recess 32 of the shell 16, resulting in the pressure within the protective vacuum spaces 31 and 36 lowering to $10^{-4}$ Pa or lower and in the heat exchange by residual gases being drastically reduced both between the housing 1 and the radiation screen and between the latter and the pumping element.

Next, the working chamber is sealed off from the pump, connected via a valve (not shown) to one of the companion flanges jointed to the bellows 40 (FIG. 3), the second companion flange being jointed, likewise via a valve, to the mechanical fore pump, and evacuated through the vessel 38 down to a pressure of about 1 Pa. In this case the vessel 38 performs the function of a nitrogen trap for oil vapors from the fore pump, preventing their ingress into the space being evacuated. With this, the process of preliminary evacuation of the working chamber is terminated.

Next, the pumping element vessel 5 is charged, via one of the tubes 13, with a cryogenic agent having a lower temperature than that of the cryogenic agent in the radiation screen vessel 15, e.g. liquid hydrogen or helium, or else with the same cryogenic agent. In the latter case, reduction in the cryogenic agent temperature in the pumping element vessel 5 is achieved by pumping out cryogenic agent vapors through the tube 13 by means of the fore pump. With the pump capacity of, e.g. 16 l/s, two hours of operation will bring the nitrogen temperature in the vessel 5 down to 55K and in the next four hours of evacuation, to 50K or lower. Liquid nitrogen is known to solidify at 63K.

Heat conductors 6,7, and 8 serve to cool the sorbent accommodated in the annular spaces 10 of the pumping element simultaneously with the vessel 5. The sorbent absorbs the gases supplied from the working chamber, providing a limiting pressure of down to $10^{-7}$ or lower. At about 50K, the sorption capacity of the sorbent is increased by several orders of magnitude as compared to its sorption capacity at the liquid nitrogen temperature (77.4K), or else the equilibrium pressure is lowered by several orders of magnitude after adsorption of the same quantity of gas.

On completion of the aforesaid operations, the pump is ready for work, and high vacuum pumping of the working chamber may be commenced by opening the seal connecting the chamber to the pump. Removal of nonadsorbable gases, such as helium and neon, is performed by means of a magnetic pump jointed to the flange 27.

Should an emergency situation arise, such as ingress of atmosphere into the pump or self-warming of the pump when liquid nitrogen is not filled in due time, the pressure at inlet to the pump may go as high as $2 \cdot 10^4$ Pa or higher. To prevent ruptures in the heat bridge 24 or other pump elements in situations of this kind, there are the valves 44 (FIG. 2) and 45. Should the pressure within the pump space exceed that in the protective vacuum spaces 31 (FIG. 1) and 36 by, e.g., $2 \cdot 10^4$ Pa, the valve 45 (FIG. 2) will operate, and the pressures in said spaces will equalize. The valve 44 will operate when the pressure in the pump space exceeds the atmospheric pressure by the same amount of $2 \cdot 10^4$ Pa, connecting the pump space to atmosphere.

The heat bridge 24 (FIG. 1) installed between the pumping element and the radiation screen shell 16 provides the possibility of enclosing the pumping element with protective vacuum on the side of the radiation screen shell 16 and on the side of the cover 35 of the radiation screen vessel 15, even though it is in itself a source of some heat input to the pumping element owing to its thermal conductivity. With this possibility, there is no heat input from the radiation screen to the pumping element that would be due to heat exchange by residual gases at working pressures of above $10^{-2}$, with the total heat input to the pumping element being reduced accordingly.

As shown by calculations, in the proposed pump the total heat input to the pumping element in the case of, e.g., argon evacuation, at the argon pressure equal to 0.1 Pa, is 2.3 times lower compared to the heat input to the pumping element in a pump having no heat bridge. At an argon pressure of 1 Pa, this heat input is reduced by 3.2 times.

At a constant inlet pressure of $10^{-1}$ Pa, the useful life of the pumping element with a vessel capacity of 8 liters to the moment when liquid nitrogen refilling is required, amounts to 300 hours, with 50 hours at an inlet pressure of 1 Pa.

The invention can be used for evacuation of spraying and plasma chemical units in, e.g., electronic industries, as well as for obtaining clean and oil-free vacuum within a pressure range of $10^2$ to $10^{-7}$ Pa in vacuum engineering while solving a broad spectrum of problems.

What is claimed is:

1. A cryogenic sorption pump, comprising:

a housing having an inlet nozzle and a bottom;

a pumping element arranged within the housing and comprising an adsorbent and a first vessel for a lower temperature cryogenic agent, said first vessel having a perimeter;

a radiation screen arranged within the housing, encompassing said pumping element, and comprising a second toroidal vessel for a higher temperature cryogenic agent having an outer wall and an inner wall and a shell having a lower end connected with said second toroidal vessel, an upper end connected with said housing, and a perimeter;

a thin-walled pipe installed in a first space defined by said inner wall of said second toroidal vessel and having a lower end sealingly connected with said bottom of said housing, and an upper end sealingly connected with said first vessel; and a heat bridge arranged within the housing and installed between said shell of said radiation screen and said pumping element and having an upper end sealingly connected with said upper end of said shell throughout said perimeter of said shell, and a lower end sealingly connected to said first vessel throughout said perimeter of said first vessel.

2. A cryogenic sorption pump as claimed in claim 1 wherein said radiation screen has perforations allowing a second space between the housing and said radiation screen to communicate with a third space between said radiation screen and said heat bridge.

3. A cryogenic sorption pump as claimed in claim 1 or 2, further comprising a third toroidal vessel accommodated within said first vessel and having two nozzles brought out of the housing in a pressure tight manner.

4. A cryogenic sorption pump as claimed in claims 1, 2, or 3, further comprising first and second emergency valves connected to said inlet nozzle, said first valve communicating with the atmosphere and said second valve communicating with said second space between the housing and said radiation screen.

* * * * *